US005405002A

United States Patent [19]

Troia

[11] Patent Number: 5,405,002

[45] Date of Patent: Apr. 11, 1995

[54] PROTECTIVE BAG FOR TRANSPORTATION OF RIVER RUNNING BOATS

[76] Inventor: Phyllis J. Troia, 17 Sunrise Ave., Plymouth, Mass. 02360

[21] Appl. No.: 174,775

[22] Filed: Dec. 29, 1993

[51] Int. Cl.[6] ..... B65D 85/00

[52] U.S. Cl. ..... 206/315.1; 206/335; 383/2; 294/151; 294/165

[58] Field of Search ..... 206/335, 315.1, 315.11; 383/2; 150/166; 224/202, 318, 320, 917; 294/149, 151, 152, 165

[56] References Cited

U.S. PATENT DOCUMENTS

| | | | |
|---|---|---|---|
| 3,838,758 | 10/1974 | Brown | 383/2 X |
| 4,267,868 | 5/1981 | Lowe | 383/2 |
| 4,315,535 | 2/1982 | Battle | 206/335 |
| 4,483,380 | 11/1984 | Besan | 206/315.1 |
| 4,746,159 | 5/1988 | Webb et al. | 224/917 X |
| 4,773,515 | 9/1988 | Kotkins, Jr. | 383/2 X |
| 4,792,073 | 12/1988 | Jacober | 206/315.1 X |

*Primary Examiner*—Jacob K. Ackun
*Attorney, Agent, or Firm*—Wolf, Greenfield & Sacks

[57] ABSTRACT

A bag for carrying and transporting a river running boat such as a kayak or C-1 having a main compartment for storing the boat, a lengthwise enclosing device such as a zipper, a plurality of straps and other devices disposed and secured along the exterior of the case to ease carrying of the boat, and length adjusting means to tighten the bag around the boat. The bag is made of strong, tear-resistant, durable material having padding throughout.

9 Claims, 7 Drawing Sheets

PROTECTIVE BAG FOR TRANSPORTATION OF RIVER RUNNING BOATS

BACKGROUND OF THE INVENTION

1. Field of the Invention

This invention relates to a device for carrying and transporting boats and, in particular, a padded protective bag for use with closed river running boats.

2. Background of the Invention

Boating is one of today's most popular outdoor activities. Many enthusiasts travel great distances to run particular rivers and rapids. In addition, many participate in closed boat competitions which are held throughout the world year round.

One of the difficulties facing participants in this outdoor activity has been how to transport equipment, especially the boat itself. In particular, airlines have been quite reluctant to transport closed boats because of potential damage that the boats may cause or possible liability of the airlines for damaged equipment.

Most racers and recreationists are forced to use closed boats which are either provided by competition organizers or rented locally. In important competitions, this disadvantage is especially onerous. Each racer normally customizes his or her boat for particular needs. For example, one racer may duck tape the seat hole for a particular fit or may adjust the height or width of the seat itself. These personal adjustments are important in providing the racer the most comfortable and responsive boat possible. After working with a particular boat, the user grows accustom to certain nuances or features of the boat. Clearly, a racer who lives close enough to a competition site to carry or otherwise easily transport his or her boat on the roof of an automobile has a distinct advantage over a racer who must spend several hours prior to competition preparing and practicing with an unfamiliar boat. For the recreationists, it is also important to be familiar with the equipment when running new or particularly strong currents and rapids.

There are several carrying and transporting devices illustrated in the prior art. Among these are several patents issued in the field of surfboard covers and carrying cases, including U.S. Pat. No. 4,804,025, issued on Feb. 17, 1989, to Bear; U.S. Pat. No. 5,094,344, issued on Mar. 10, 1992, to Savage; U.S. Pat. No. 5,033,497, issued on Jul. 23, 1991, to Hernandez; and U.S. Pat. No. 4,793,535, issued on Dec. 27, 1988, to Johnson. In addition, the inventor knows of a product called "New Wave" which is merely a unpadded covering for personal boats which are smaller than the river running boats considered in the present invention. Finally, the only relevant device known to the inventor is illustrated in U.S. Pat. No. 4,157,138, issued on Jun. 5, 1979, to Duncan.

The primary problem with the surfboard covering cases enumerated above is that they are unsuitable for carrying and transporting closed boats. The differences in size, shape, weight, and other needs for surfboards and closed boats is substantial. Furthermore, surfboard covers are not fully enclosed nor would they provide the necessary protection for the person carrying the boat, the vehicle transporting the boat, or the boat itself. For example, Bear '025 merely shows a harness or sling device for carrying the surfboard. No consideration is given to protecting the surfboard along its length. Savage '344 illustrates a surfboard carrying case having a soft forward region and a rear hard portion for accommodating the fins of the surfboard. This disclosure fails to teach how to adapt the device for use with a closed boat including how to easily load a closed boat.

Duncan '138 essentially shows a paperboard packaging for a canoe. Duncan '138 discloses the lack of advancement in the art of transporting closed boats.

Beyond shipping crates, no satisfactory device has been available for both transporting and carrying river running boats, especially closed boats.

SUMMARY OF THE INVENTION

It is an object of the present invention to provide a transportation bag for a closed river running boat which protects the boat from damage, the vehicle holding or carrying the boat from damage, and the person carrying the boat from injury.

It is a further object of the present invention to provide a transportation bag for a closed boat which may be quickly and easily loaded and unloaded.

It is a further object of the present invention to provide a transportation bag for a closed boat which provides means for accommodating equipment and gear normally required for closed boats.

It is a further object of the present invention to provide a transportation bag for a closed boat which is easy to carry and transport.

It is an object of the present invention to provide a bag which may accommodate boats over a variety of sizes and which is adjustable to the specific length of the boat contained in the bag.

The present invention includes a main compartment for storing the river running boat, a lengthwise enclosing device such as a zipper, a plurality of straps and other devices disposed and secured along the exterior of the case to ease carrying of the boat, and length adjusting means to tighten the bag around the boat. The bag is made of strong, tear-resistant, durable material having padding throughout.

BRIEF DESCRIPTION OF THE DRAWINGS

The purpose and objects of the present invention may be better understood from the following drawings and detailed description, in which.

DETAILED DESCRIPTION

Figure 4:
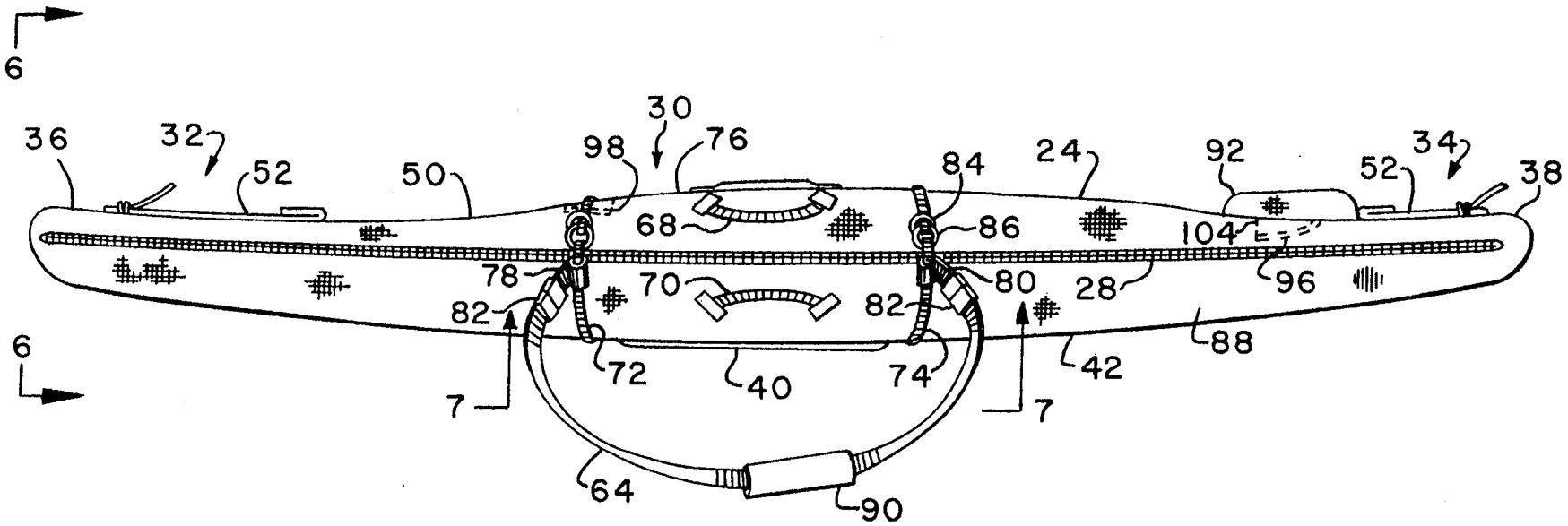
FIG. 4 is the side view of the present invention opposite from FIG. 3.
Figure 5:
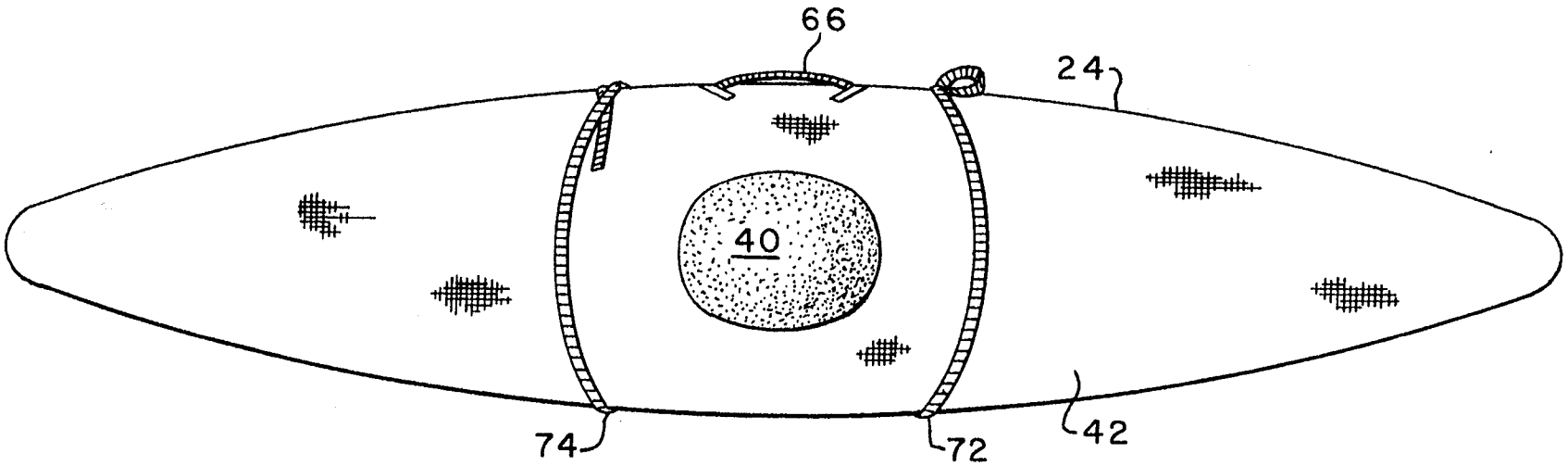
FIG. 5 is a bottom view of the present invention.
Figure 6:
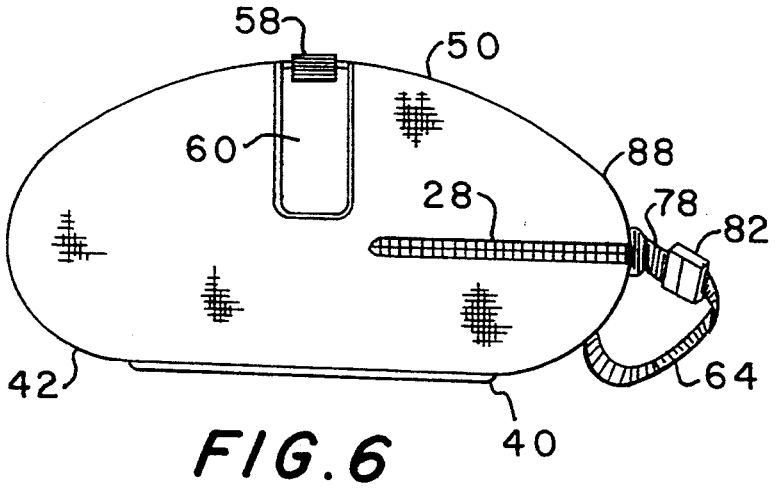
FIG. 6 is an end view of the present invention taken along the line 6—6 of FIG. 4 with the opposite end view being substantially the same.
Figure 7:
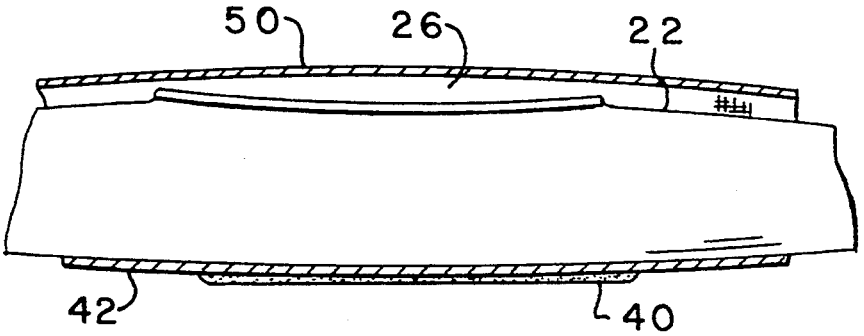
FIG. 7 is a cross-sectional detailed view taken substantially along the line 7—7 of FIG. 4.
Figure 8:
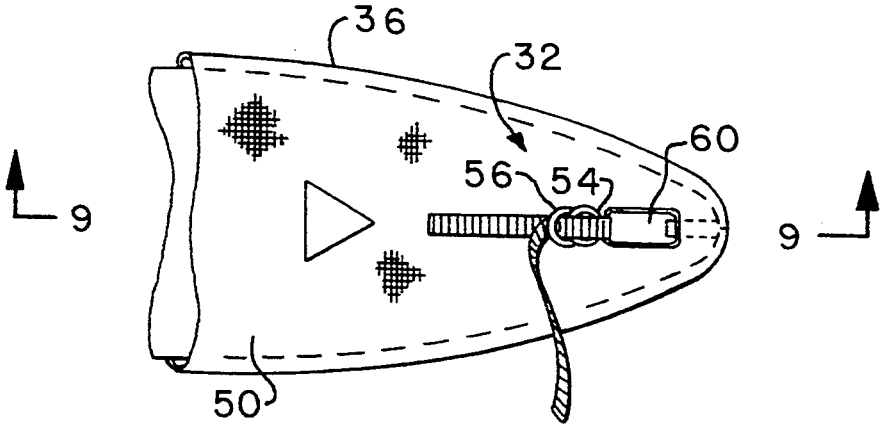
FIG. 8 is a detailed view of the end of FIG. 6 after to tightening the bag.
Figure 9:
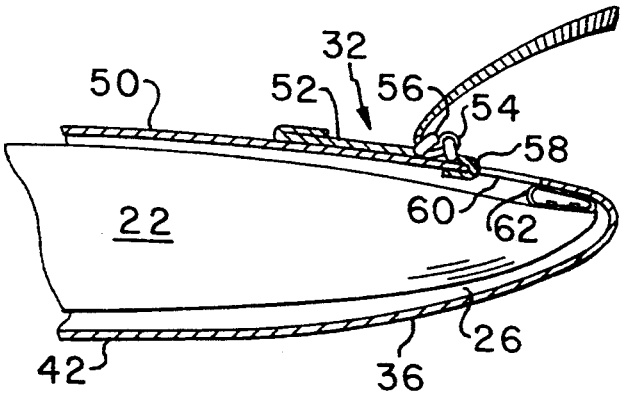
FIG. 9 is a cross-sectional view taken along the line 9—9 of FIG. 8.
Figure 10:
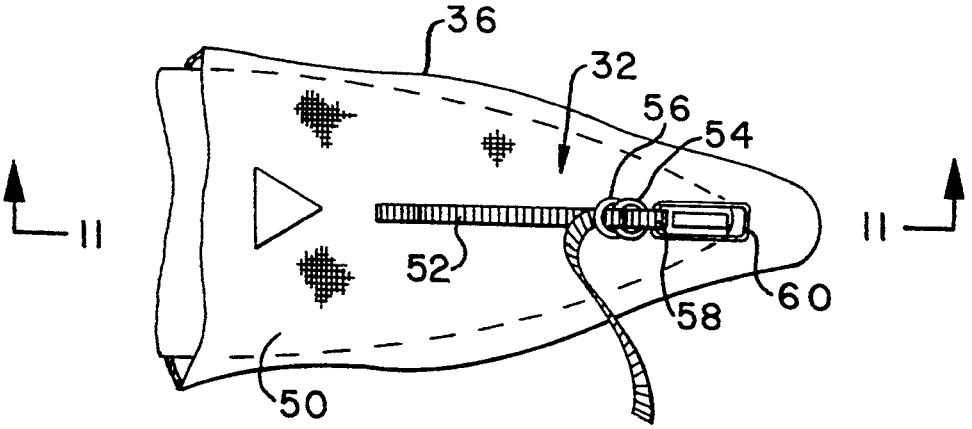
FIG. 10 is a detailed view of the end of FIG. 8 prior tightening the bag.

The overall configuration of the present invention may best be seen in FIGS. 2–5 and 7. A transportation/- carrying bag 20 for a river running boat 22, such as a kayak or C-1 (FIG. 7), comprises a generally banana-shaped padded tubular body 24 defining an interior or main compartment 26 (FIG. 7) within which the boat 22 is contained, a lengthwise heavy duty zipper 28 extending along one side of the body 24 (FIG. 4), a plurality of carrying straps 30, and a pair of compression assemblies 32 and 34 at the tapered ends 36 and 38 of the bag 20. Finally, the bag 20 has a patch 40 secured to the bag bottom 42, as shown in FIG. 5. The patch 40, preferably sewn to the bag bottom 42, is made of a soft, but durable, material providing additional padding for the bag 20. The patch 40 is preferably coated with 1400 neoprene nylon for anti-skid characteristics. While the patch 40 illustrated is oval, any shape may be used including use of a plurality of patches. The patch 40 should be centered on the bag bottom 42 where the bag 20 is most likely to rest.

While the preferred embodiment accommodates boats having a maximum length of 13 feet and weight of 70 pounds, larger and smaller parameters are possible. These limitations are only based on current conventional commercial airline luggage restrictions.

Figure 1:
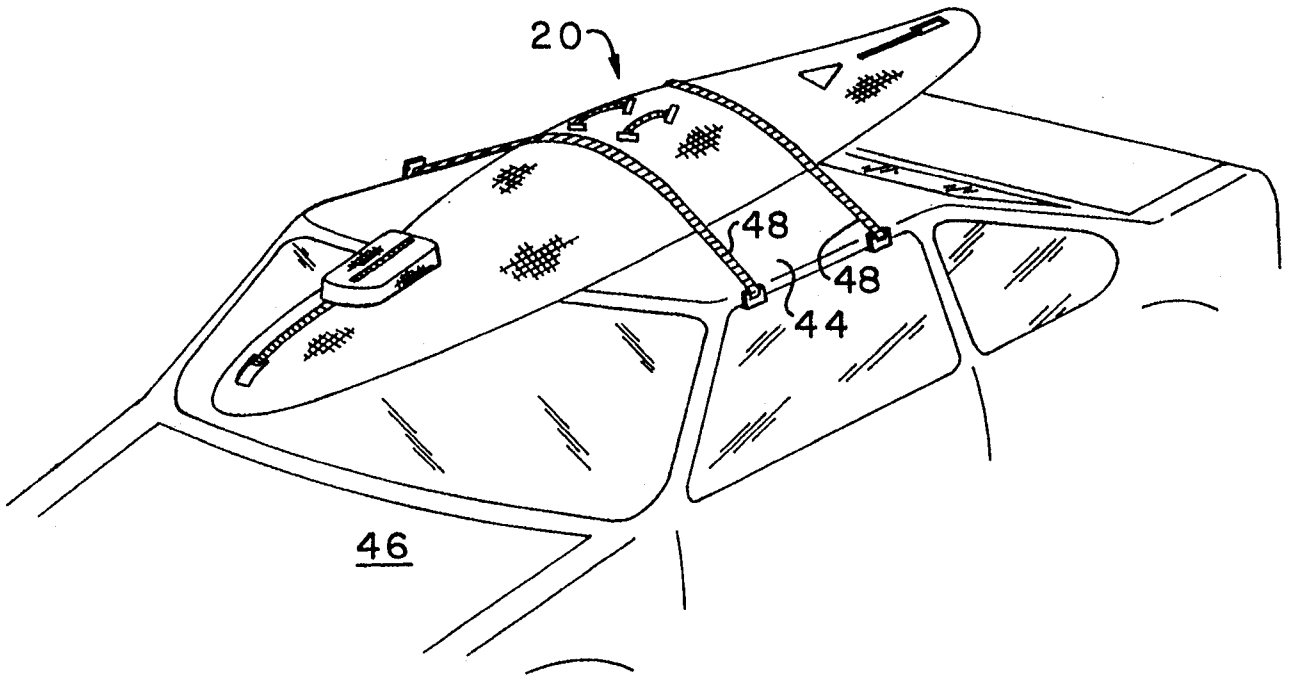
FIG. 1 shows the present invention secured to the roof of an automobile.

FIG. 1 illustrates the bag 20 on the roof 44 of an automobile 46. A pair of roof straps 48 anchor the bag 20 to the automobile roof 44 in a common arrangement for transporting boats. The patch 40 contacts the automobile 46 and prevents scratching of the roof 44.

The compression assemblies 32 and 34 are sewn to the top 50 of the bag 20 along the central axis (FIGS. 8–11). Each assembly 32 and 34 includes a compression strap 52 and a pair of preferably stainless steel one-inch diameter D rings 54 and 56. The rings 54 and 56 are secured over a short strap 58 which, in turn, is sewn to the bag 20 in parallel facing alignment with the compression strap 52 to enable the strap 52 to be looped through the rings 54 and 56 in a standard securing arrangement. The compression assemblies 32 and 34 permit the user to tighten the bag 20 around the boat 22, particularly when the boat being transported is substantially shorter than the bag 20.

Figure 11:
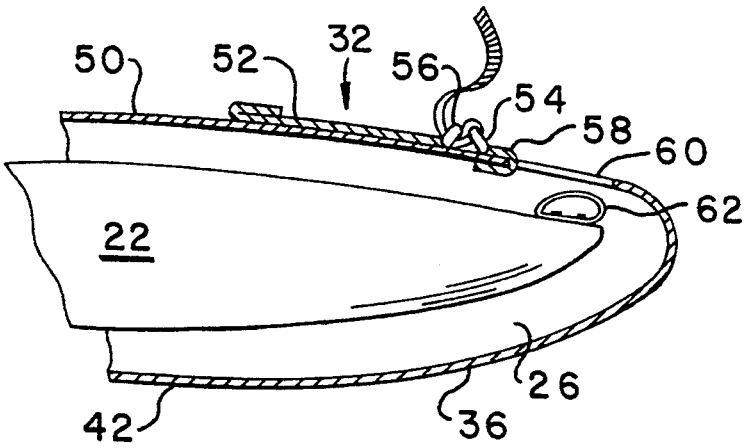
FIG. 11 is a cross-sectional view taken along the line 11—11 of FIG. 10.

Colinear and positioned between the ends 36 and 38 and the compression assemblies 32 and 34 are a pair of reinforced slits 60 (FIG. 11). The slits 60 provide access to the main compartment 26 of the bag 20. Most C-1s and kayaks are equipped with grab loops 62 at each end to allow two people to simultaneously carry the boat 22. This convenience is not lost in the present invention because the grab loops 62 are accessible through the slits 60. The grab loops 62, which are commonly either fabric or metal, are aligned with slits 60 after the compression assemblies 32 and 34 are tightened.

The plurality of carrying straps 30 form essentially two arrangements. A shoulder strap 64 and associated grab handle 66 combine to form the first arrangement, and a pair of proximal parallel facing hand straps 68 and 70 form the second arrangement.

For travel by airplane in particular, it is often necessary to remove all shoulder straps to avoid tangling with other luggage and baggage machinery and to facilitate handling. For such travel, the shoulder strap 64 is removably secured to the bag 20 by means of a pair of securing straps 72 and 74. The straps 72 and 74 are sewn substantially around the circumference of the bag 20 on either side of the center area 76 except for a small region where the shoulder strap 64 is buckled to small extensions 78 and 80 on each strap 72 and 74. The connection between the extensions 78 and 80 and the shoulder strap 64 are quick-release buckles 82 such as those commercially available under the mark Fastex. The extensions 78 and 80 are removably looped over the straps 72 and 74 which are secured to themselves by any standard arrangement such as stainless steel rings 84 and 86 to permit the user to fully unzip the bag 20 (FIG. 4).

The securing straps 72 and 74 also distribute the stress on the bag 20 when the bag 20 is carried by the shoulder strap 64 thereby substantially mitigating chances of tearing.

Figure 2:
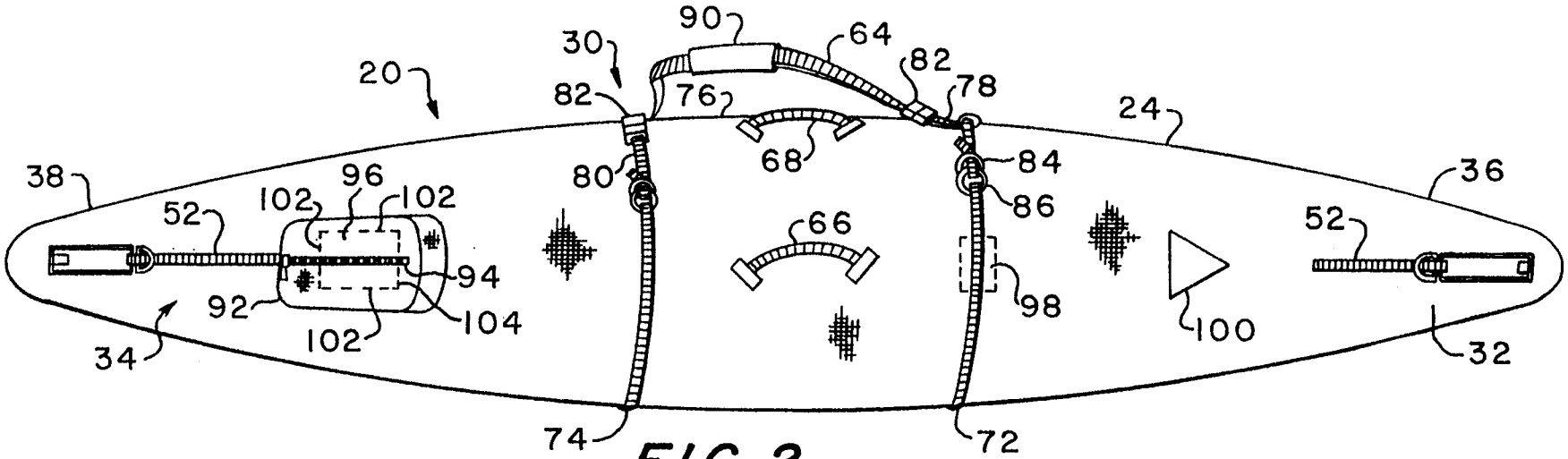
FIG. 2 is a top view of the present invention.
Figure 3:
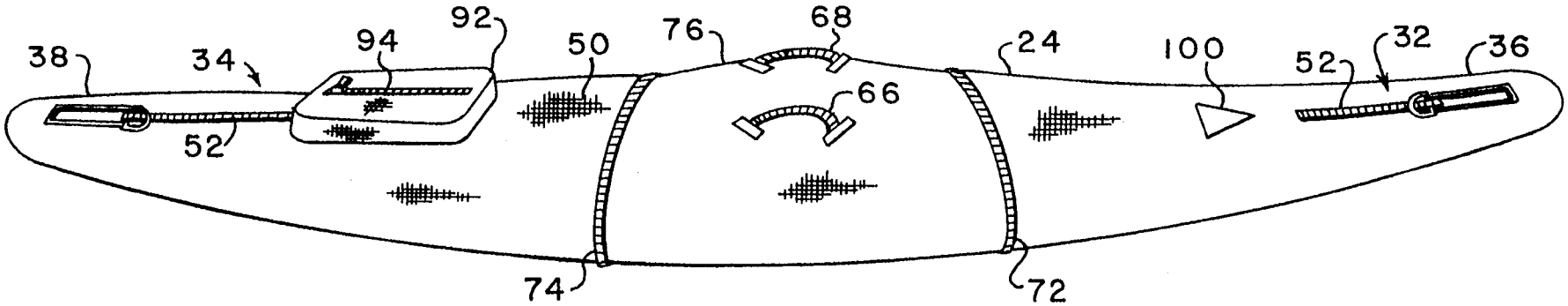
FIG. 3 is a side view of the present invention.

When using the shoulder strap 64 over either shoulder, the user may grasp the associated grab handle 66. The handle 66 is preferably secured to the top 50 of the bag 20 approximately ten inches from the zipper 28. This arrangement also requires the strap 64 to be positioned on the zipper side 88 of the bag 20 (FIGS. 2 and 4). These locations provide easier handling because most closed boats, have a shorter height than width and this allows the boat 22 to be carried on its side.

The straps 72 and 74 are preferably webbed nylon having a one inch width. The shoulder strap 64 is also webbed nylon, but it has a two inch width. The shoulder strap 64 may have a shoulder pad 90 for additional comfort.

The second means provided for carrying the bag 20 is the pair of facing hand straps 68 and 70. The straps 68 and 70 are sewn to the bag 20, one on each side of the zipper 28 (FIG. 4). Like the shoulder strap 64 location, this arrangement also places the boat 22 on its side when being carried.

In the preferred embodiment, the bag 20 has a mesh pouch 92 for accommodating various personal and boating effects. The pouch 92 preferably has a zipper 94 and is made from UV light inhibiting monofilament polypropylene. While only one pouch 92 is shown in a particular location, the number of pouches and the locations may obviously vary.

Finally, in the preferred embodiment, a storage system comprising a blade pocket 96 and a shaft band 98 provide means for securing either single-bladed C-1 paddles or double-bladed or breakdown kayak paddles. While the illustrations in FIGS. 2 and 4 show in phantom the blade pocket 96 and band 98 in the main compartment 26 below the pouch 92 and strap 72 locations respectively, the blade pocket 96 and band 98 may be located on the exterior on the bag 20, or below the logo design 100 and strap 74 respectively. The shaft band 98 is appropriately distanced from the blade pocket 96 to secure the paddle along the shaft of a C-1 paddle just below the T-grip handle, a fixed double-bladed kayak paddle, or a pair of shafts from a breakdown kayak paddle. Finally, the pocket 96 and shaft band 98 should be large enough to hold a pair of C-1 paddles, including one spare, if desired.

The pocket 96 is secured to the inside of the bag 20 along three sides 102 and is open along the remaining side 104. The pocket 96 has a triangular cross-section and may be pleated as shown, although other desired shapes and features are available to accommodate the paddle blade, blades, or portions thereof. The shaft band 98 is also sewn to the inside of the bag 20 and is preferably made of Velcro so that the band 98 may be secured onto itself after positioning the paddle shaft.

The material used in the preferred embodiment for the body 24 of the bag 20 is nylon pack cloth. An interior padding of preferably ¼ inch urethane foam is secured to the inner surface of the outer fabric by suitable means.

Various changes and modifications and equivalents of the embodiment described above and shown in the drawings may be made within the scope of this invention. It is intended that all matters contained in the above description or shown in the accompanying drawings are presented by way of example only and are intended to be interpreted in an illustrative and not limiting sense. It should be further understood that the particular components and location of those components do not provide a limitation to the claimed invention.

What is claimed is:

1. A combination river running boat and transportation means therefor, comprising:

a river running boat;

a padded bag having a generally banana-shaped tubular body defining a main compartment for receiving and storing said river running boat within, said bag further having a top, a bottom, a first side and a second side; a carrying means; and means for effectively shortening the length of said bag to the length of said boat.

2. The combination as set forth in claim 1, wherein said carrying means includes a first carrying arrangement having a removable shoulder strap and associated grab handle, said grab handle positioned on said bag to be accessible when using the shoulder strap.

3. The combination as set forth in claim 2, wherein said carrying means further includes a second carrying arrangement defined by a pair of parallel facing hand straps.

4. The combination as set forth in claim 2, wherein said shoulder strap is secured to the first side of the bag and said grab handle is secured to the top of the bag such that when said first carrying arrangement is in use the boat within is carried on its side.

5. The combination as set forth in claim 1, wherein said means for shortening the length of the bag includes a compression assembly having a compression strap for effectively reducing the length of the bag.

6. The combination as set forth in claim 5, further comprising a pair of openings formed at either end of the bag for access to the interior and to the ends of the boat within the bag.

7. The combination as set forth in claim 6, having a pair of said means for shortening said bag with one of said openings between an end of the bag and one of said means for shortening.

8. The combination as set forth in claim 1, wherein said carrying means further includes a blade storage system comprising a blade pocket linearly aligned with a shaft band.

9. The combination as set forth in claim 3, wherein said hand straps are secured to the first side of the bag such that when said second carrying arrangement is in use the boat within is carried on its side.

* * * * *